United States Patent [19]

Traub

[11] Patent Number: 4,750,346

[45] Date of Patent: Jun. 14, 1988

[54] LINK DRIVE FOR BENDING ARM OF TUBE BENDING MACHINE

[75] Inventor: Zeno P. Traub, Vista, Calif.

[73] Assignee: Eaton Leonard Technologies, Inc., Carlsbad, Calif.

[21] Appl. No.: 101,067

[22] Filed: Sep. 25, 1987

[51] Int. Cl.[4] ..... B21D 7/04

[52] U.S. Cl. ..... 72/149; 83/601

[58] Field of Search ..... 72/149, 154, 155, 156, 72/157, 158, 159, 320, 321; 83/601

[56] References Cited

U.S. PATENT DOCUMENTS

| | | | |
|---|---|---|---|
| 1,135,875 | 4/1915 | Brinkman | 72/159 X |
| 1,422,779 | 7/1922 | Perony | 72/450 |
| 2,754,879 | 7/1956 | Gautier | 153/40 |
| 2,871,909 | 2/1959 | Bower | 72/321 |
| 4,063,441 | 12/1977 | Eaton | 72/151 |
| 4,178,788 | 12/1979 | Zollweg et al. | 72/154 |
| 4,552,006 | 11/1985 | Yogo | 72/149 |

FOREIGN PATENT DOCUMENTS

| | | | |
|---|---|---|---|
| 314226 | 9/1919 | Fed. Rep. of Germany | 72/149 |
| 2642942 | 3/1978 | Fed. Rep. of Germany | 72/149 |
| 987148 | 3/1965 | United Kingdom | 72/149 |
| 627885 | 10/1978 | U.S.S.R. | 72/149 |

*Primary Examiner*—E. Michael Combs

*Attorney, Agent, or Firm*—Gausewitz, Carr & Rothenberg

[57] ABSTRACT

A drive mechanism for the bend arm of bending apparatus wherein a drive motor has the drive shaft thereof generally parallel to the axis of pivoting of the bend arm assembly, and along a line at an angle to the feed direction of a tube. The drive shaft is directly coupled to a bell crank having first and second generally perpendicular arms. A like bell crank arrangement is formed in the bend arm and is driveably coupled to the bend arm pivot shaft with the bend arm bell crank in aligned relation to the drive motor bell crank. First and second generally identical rigid noncompliant link arms have the first ends thereof pivotally coupled to the free ends of the arms of the bend arm bell crank, with the other end thereof pivotally coupled to the free ends of the drive motor bell crank. The link arms are generally L-shaped, with the distal ends of the short legs thereof coupled to the bend arm bell crank, one of the ends above the crank and one below the crank. The distal ends of the long arms are similarly interconnected with one above and one below the drive motor bell crank. The position of the drive shaft relative to the tube feed direction, coupled with the angular configuration and spatial positioning of the short leg relative to the long leg of the link member enables pivoting of the bend arm through an angle in excess of one hundred eighty degrees.

24 Claims, 3 Drawing Sheets

LINK DRIVE FOR BENDING ARM OF TUBE BENDING MACHINE

CROSS-REFERENCE TO RELATED APPLICATION

The subject matter of this invention is related to a patent application by Qthe inventor hereof, Ser. No. 101,063, filed concurrently herewith and assigned to the assignee of the instant application, such application being entitled "Bend Arm Apparatus for Tube Bending Machine With Cammed Clamp Die Arrangement", such patent application being incorporated by reference as though fully set forth herein.

BACKGROUND OF THE INVENTION

The background of the invention will be discussed in two parts.

FIELD OF THE INVENTION

This invention relates to tube or pipe bending machines, and more particularly, to a link drive for the bend arm thereof.

DESCRIPTION OF THE PRIOR ART

Automatic or manual tube or pipe bending machines have been developed to feed a given length of pipe through a pipe bending mechanism to serially provide a predetermined number of bends of given angles at a given direction, with a predetermined spacing between bends. For example, an exhaust pipe of an automobile may be one such example of a pipe with multiple spaced bends at differing angular orientations, such bends necessarily being formed to provide clearance for the exhaust pipe of certain structural members or components of the vehicle on the underside thereof.

In the bending of pipes or tubes of varying size, automated pipe or tube bending machines have been developed. In such machines, the tube is fed, such as from a length of tubing or a coil, through a rotatable chuck or collet gripping arrangement, to a tube bending zone. Typically, the tube bending zone includes a rotary bend die having a concave at least partially circumferential groove corresponding to a radius of the diameter of the pipe or tube to be bent. The tube is fed until the tube is positioned at the bend die at the location to be bent. A bend arm assembly, including a clamp die mechanism, is then actuated to position a clamp die, having a like formed concave groove, into abutting relation with the pipe at the bend point, and force or pressure is applied to the clamp die to physically restrain the pipe at the bend die. The pipe to be bent may be of relatively large diameter, such as a vehicle exhaust pipe, or may be of relatively small diameter, such as a tube for hydraulic or air pressure operated apparatus.

In any event, very high rotational forces are needed to pivot the bend arm assembly through the desired angle, often in excess of one hundred eighty degrees, relative to the base of the tube bending machine. In such prior art machines, the driving force of the bend arm assembly has been accomplished through varying means, such as chain and sprocket drives, gear box drive arrangements, and rack drive arrangements. With chain and sprocket drives, constant lubrication is required. Such chain drives are driven by a servo motor which drives the chain in both directions. In such arrangements, due to the high loading of the drive member, and the chatter occasioned by the servo drive, the chain needs constant tension adjustment. In addition, since the chain works in both directions, it stretches, resulting in excessive wear, of both the chain and sprocket, and often, breakage. With gear box drive arrangements, in order to provide the high loads, substantial gear reduction is required, with the attendant result of a bulky gear box, which interferes with or undesirably protrudes into, the bending area. With a rack type bend arm drive arrangement, interference with the bending area is encountered.

Prior art pipe or tube bending machines are shown and described in U.S. Pat. No. 4,178,788, and U.S. Pat. No. 4,063,441, both of which depict prior art bend arm drive arrangements for tube bending machines.

Another bend arm drive arrangement is shown in U.S. Pat. No. 4,552,006, entitled "Bending Apparatus", which issued to Yogo on Nov. 12, 1985. In this apparatus, a single drive link has one end thereof provided with a drive pin for pivotal coupling to the bend arm. The other end of the link is supported by means of first and second bearing arrangements, each supporting a shaft parallel to the other, with the adjacent ends of the shafts supporting upper discs, each disc having a crank pin radially displaced from the respective shaft the same distance. The opposite ends of the shafts are coupled to other means for synchronizing the angular movement of both discs. In one embodiment, lower discs are provided on the opposite ends of the shafts with crank pins thereon coupled to opposite ends of an interconnected stabilizer link. Drive is effected by a sprocket coupled to one of the shafts, with a motor driving the sprocket through a chain. In the other embodiment, a rack engages gears coupled to the lower ends of the shafts, with a hydraulic cylinder causing movement of the rack, which, in turn, angularly displaces the crank pins on the upper discs to move the link through the desired distance to effect pivoting of the bend arm. Such a prior art bend arm drive arrangement is unduly complicated, and uses either the chain or rack drives with the previously mentioned disadvantages. Moreover, the single drive link itself is subject to substantial bending forces.

In accordance with an aspect of the invention, it is an object of the invention to provide a new and improved link drive mechanism for a bend arm assembly, which drive mechanism is compact and positively positionable with little or no adjustment required.

SUMMARY OF THE INVENTION

The foregoing and other objects of the invention are accomplished by providing a drive mechanism for the bend arm of bending apparatus wherein a drive motor has the drive shaft thereof generally parallel to the axis of pivoting of the bend arm assembly, with the drive shaft directly coupled to a lever having first and second arms. A like lever is driveably coupled to the bend arm pivot shaft with the arms of the bend arm lever in aligned spatial relation to the arms of the drive motor lever. First and second generally identical rigid non-compliant link arms have the first ends thereof pivotally coupled to the free ends of the arms of the bend arm lever, with the other ends thereof pivotally coupled to the free ends of the drive motor lever. According to a feature of a preferred embodiment, the link arms are generally L-shaped, with the ends of the short legs thereof coupled to the bend arm lever, one of the ends above the lever and one below the lever. The free ends of the long arms are similarly interconnected with one above and one below the drive motor bell crank. The angular configuration of the short leg relative to the long leg of the link member enables pivoting of the bend arm through an angle in excess of one hundred eighty degrees. With this arrangement, the links transfer forces from the drive motor to the bend arm assembly, with the rotational force applied to the bend arm assembly by each link at any point in time being determined by the angular displacement of the pivot pin of the link relative to an imaginary line between the motor drive shaft and the bend arm shaft. Through certain angles of rotation, one link may be pushing relative to the bend arm assembly, with the other link pulling. Through other angles of rotation, both links may be pulling. In any event, the links act cooperatively, that is, either a pulling force or a pushing force is translated into a rotational force applied to the bend arm assembly. With two links, the bend arm drive structure near the bending axis is compactly arranged.

Other objects, features and advantages of the invention will become readily apparent from a reading of the specification, when taken in conjunction with the drawings, in which like reference numerals refer to like elements in the several views.

DESCRIPTION OF THE PREFERRED EMBODIMENT

The apparatus to be described herein may be used with many different types of workpiece bending machines and, in fact, with most tube bending machines of the type having a rotary bend die in fixed position relative to a base, with a clamp die carried by a bend arm mechanism, for bending a tube, with or without a pressure die, and whether the bending be compression or draw bending. Furthermore, principles of the invention may readily be applied to still other types of bending machines.

A typical bending machine in which the apparatus shown and described herein may be used is shown in U.S. Pat. No. 4,063,441, entitled "Apparatus for Bending Tubes", which issued to Eaton on Dec. 20, 1977. The disclosure of such patent is incorporated by this reference as though fully set forth herein.

Figure 1:
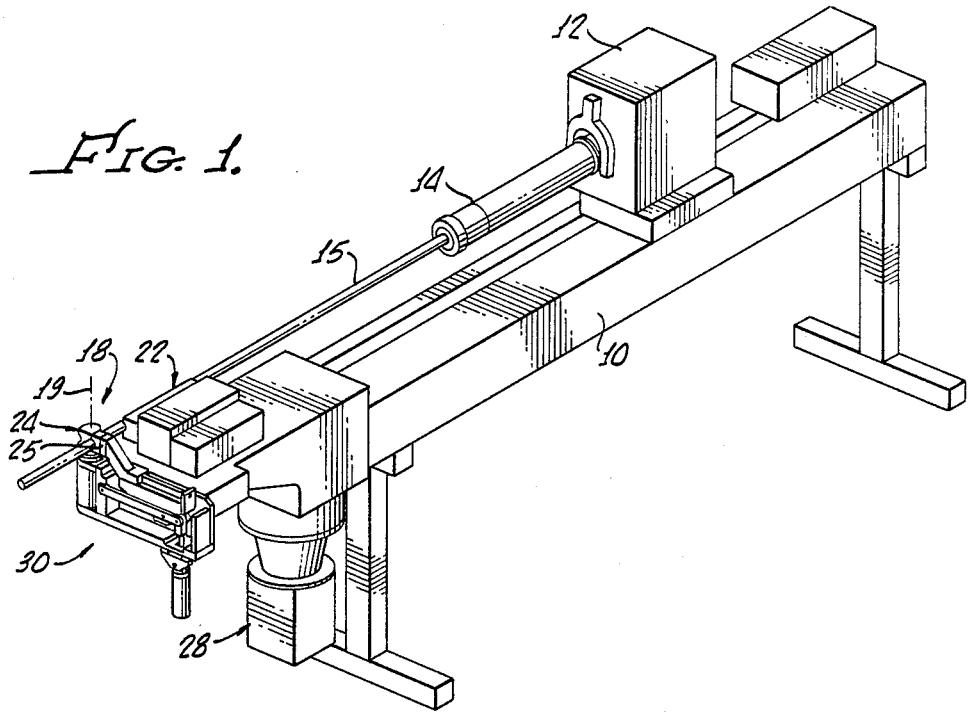
FIG. 1 is a perspective view of tube bending apparatus utilizing the bend arm assembly with the link drive mechanism according to the invention.
Figure 2:
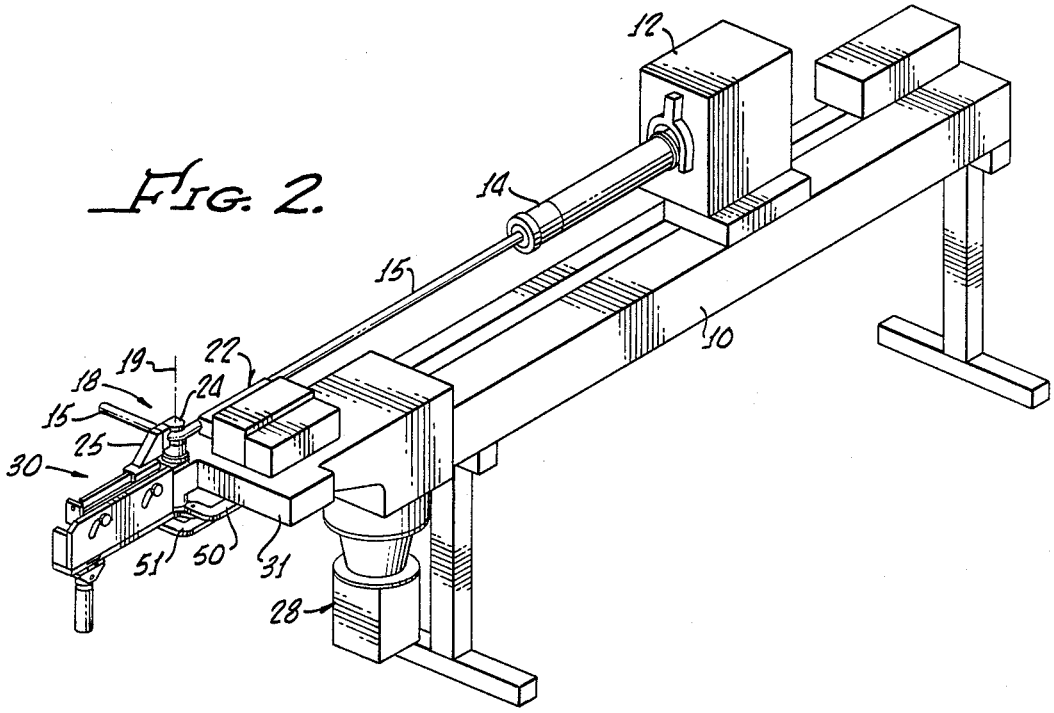
FIG. 2 is a perspective view similar to FIG. 1 with the bend arm assembly pivoted to a tube bending position by the link drive mechanism of the present invention.

Referring now to the drawings, and particularly to FIGS. 1 and 2, there is shown a tube bending apparatus. Briefly, the apparatus includes a fixedly supported base or bed 10 having a moving carriage assembly 12 that carries a rotatable chuck 14. The latter grips a workpiece, such as a tube 15, which is to be advanced and rotated for preselected positioning with respect to dies at the tube bending station, generally indicated at 18. When used for bending, the tube 15 is restrained at a point intermediate the chuck 14 and the bending station 18 by suitable means such as a restraint block 22. For draw bending a pressure die may be utilized. At the bending station 18, there is a rotatable bend die 24 which rotates about a pivot axis 19, and a clamp die 25, pivotable together with the bend die 24 about the same axis. The bend die 24 may be provided with a replaceable insert for cooperation with the clamp die 25. The bend die 24 and the clamp die 25 are each provided with grooves for coaction with one another to define an opening for receiving the tube 15 between the dies. A swinging bend arm assembly 30 is mounted for pivotal movement relative to a corner of the bed 10 for pivoting under force of a driving mechanism, generally designated 28, (mounted below the bed 10), the assembly 30 pivoting along with the bend die 24 about the pivot axis 19 of the latter, with the bend arm assembly 30 carrying the clamp die 25 and its operating mechanism.

For a bending operation, the carriage assembly 12 advances the tube 15 and the chuck 14 rotates the tube 15 for positioning with respect to the dies. In general, in this type of machine, the block 22 urges against a portion of the tube 15 rearwards of the bend die 24. FIG. 1 depicts the tube bending apparatus with the tube 15 in position for bending. Both the clamp die 25 and the bend die 24 clamp a forward portion of the tube, and the bend arm assembly 30, which carries the clamp die 25, is rotated about a substantially vertical axis 19 (that is, vertical as shown in the illustrated arrangement) through the center of the bend die 24, with the block 22 restraining the rear portion of the tube 15. As shown in FIG. 2, this bends the tube 15 about the bend die 24 through the desired bend or pivot angle. Thereafter, the clamp die 25 is retracted relative to the bend die 24, the bend arm assembly 30 is returned to its original position, the carriage 12 is advanced, and the chuck 14 is rotated to properly position the tube 15 both longitudinally and rotatably for the next bend. The apparatus for positioning and advancing the tube 15 is fully shown and described in the aforementioned U.S. Pat. No. 4,063,441, and a further explanation thereof herein is unnecessary to an understanding of the instant invention.

In accordance with the present invention, there is provided a new and improved link drive mechanism 28, in which the drive arrangement is formed of a pair of solid interconnecting arms or links, which require no adjustment during use, and enable direct transfer of large amounts of rotational force to accomplish the bending operation, that is, pivoting of the bend arm assembly 30. By reference to FIG. 3, the pivotable bend arm member, designated with reference numeral 38, is a bend arm portion of the lower housing of the bend arm assembly 30, which is of an L-shaped elongate bar configuration fixedly attached relative to the bend arm assembly 30 and pivotally attached relative to the bed 10 of the bending apparatus. The exact construction of the bend arm 38 and the bend arm assembly 30 is shown and described in the aforementioned cross-referenced patent application.

Figure 3:
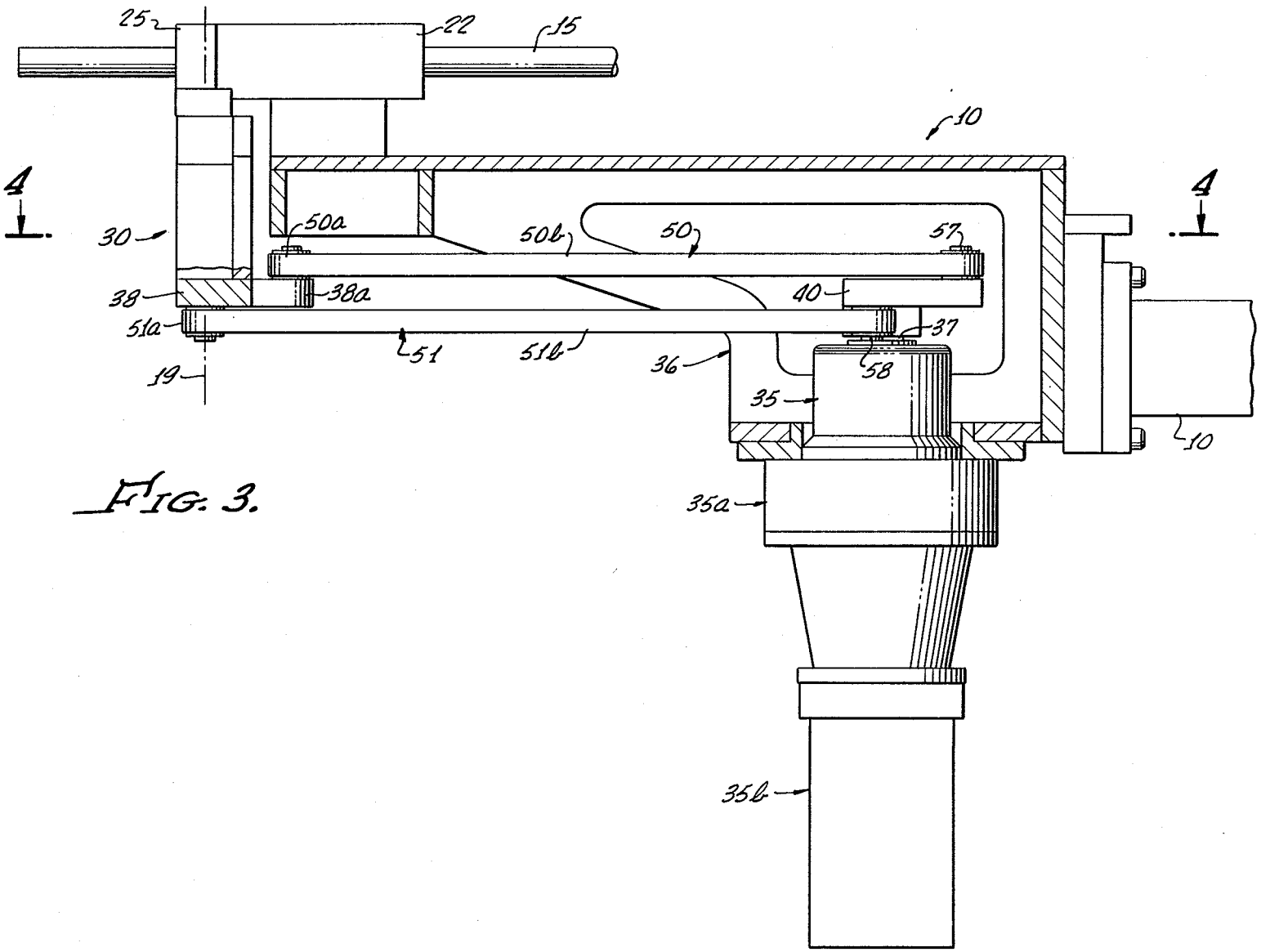
FIG. 3 is a side view of the drive mechanism of the present invention, partially broken away.
Figure 4:
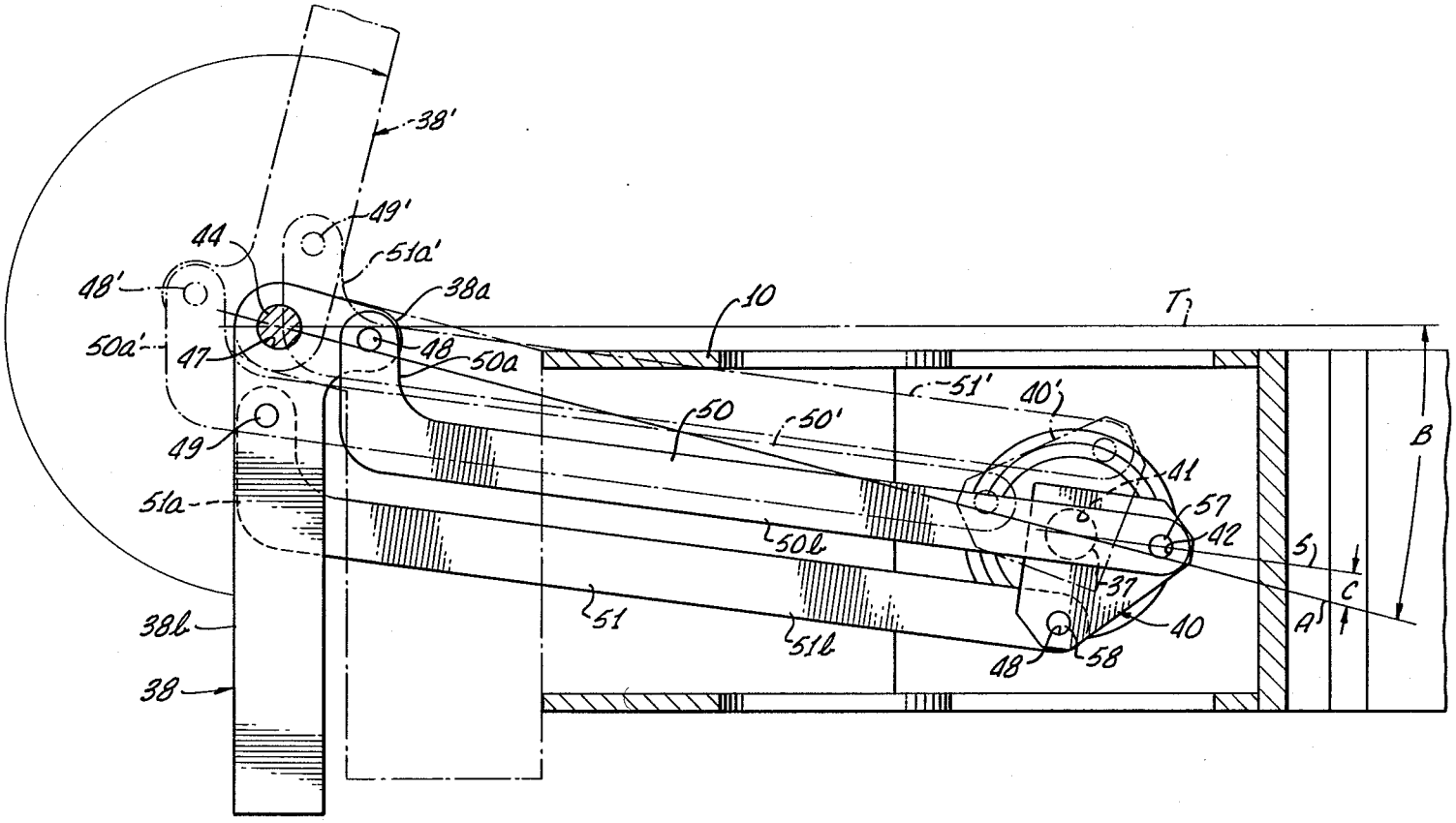
FIG. 4 is a top plan view of the drive mechanism of FIG. 3, as viewed generally along line 4—4 thereof.

Referring now to FIGS. 3 and 4, there is shown the link drive mechanism 28, which includes a gearmotor drive 35, the housing of which is solidly coupled to a rigid housing portion 36 secured to the bed 10 of the bending apparatus beneath the bed. The gearmotor drive 35 includes an upper gear box portion 35*a* and a lower drive motor 35*b*, with a driven shaft member 37 extending along a line generally parallel to the bend arm assembly pivot axis 19, this being the axis on which the bend die 24 pivots. Coupled to the upper end of the shaft 37 is a lever, such as a bell crank member 40, which is depicted in FIG. 4 as a generally triangular member having an aperture 41 at the apex thereof for fixed non-rotational coupling to the shaft 37. Second and third apertures 42 and 43 are formed in the member 40 at positions along imaginary lines which form a right angle with the aperture 41 at the corner of the right triangle. Each of the apertures 42 and 43 is displaced the same distance from the aperture 41.

A second lever, such as a bend arm bell crank arrangement, is provided for coupling to the drive shaft 44 of the bend arm assembly 30, the bell crank arrangement being fixed to or built into the bend arm 38 of the bend arm assembly 30. Bend arm assembly 30 is fixed to shaft 44 which, in turn, is mounted to the end of the machine bed for rotation about bend axis 19. The lower bend arm 38, as previously described, is an elongate L-shaped bar member with a short leg 38*a* and a long leg 38*b*. These legs 38*a* and 38*b* effectively form the second lever. At the juncture of the two legs, there is an aperture 47 into which the bend arm pivot shaft 44 extends, the shaft 44 being coupled for concurrent rotation or pivoting with the arm 38 and, hence with the bend arm assembly 30. The bend die 24 is likewise coupled to the shaft 44 for concurrent pivoting therewith. Drive points, such as first and second pivot pins 48, 49 are affixed to the bend arm 38, each being the same distance from the center of the drive shaft 44. An imaginary line drawn from the center of shaft 44 to the center of pivot pin 48 is perpendicular to another imaginary line drawn from the center of shaft 44 to the center of pivot pin 49.

The distance between the center of the drive shaft 44 and the center of each of the pivot pins 48, 49, is equal to the distance between the center of aperture 41 and the center of each of apertures 42, 43 of crank member 40. As assembled the crank member 40 is in horizontal alignment with the crank arrangement formed in the bend arm 38, as shown in FIG. 3, that is, they lie in a common plane. Also, as shown in FIG. 4, the orientation of an imaginary line between apertures or pivot pins of bell crank member 40 is the same as the orientation of an imaginary line between the apertures or pivot pins of the crank portion of the bend arm 38, that is, the angular orientations in space in the horizontal plane are identical.

First and second generally identical, rigid, noncomplaint link arms or members 50, 51 are provided for pivotal interconnection of the bell crank member 40 to the bell crank portion of the bend arm 38. The assembly of the two links and the two bell crank members forms a parallelogram. Each of the link arm members 50, 51 is generally L-shaped with a short leg 50*a*, 51*a* and a long leg 50*b*, 51*b*. The actual angle between the short and long legs of each of the link arm members is about ninety-eight degrees which, as can be seen in FIG. 4, enables the outer edge of the short leg 51*a* of link 51 to lie within the dimension of the bend arm 38, with the bend arm assembly 30 in its normal position. The ends of the short legs 50*a*, 51*a* of link arm members 50, 51, respectively, are coupled to the pivot pins 48, 49, respectively, of the crank portion of bend arm 38, with one of the legs 50*a* above the bend arm 38 and the other leg 51*a* below similarly interconnected with the drive motor bell crank 40 by means of other drive points, such as pivot pins 57, 58, respectively, with one leg 50*b* above the crank 40 and the other leg 51*b* below the drive motor bell crank 40.

As shown in FIG. 3, the planes of the link arm members 50 and 51 are generally parallel with one another with the plane of the crank member 40 and bend arm 38 lying intermediate the two planes. Also, as shown in FIG. 4, in an orthogonal plane, the longitudinal axes of the long legs 50*b* and 51*b* of link members 50 and 51 are parallel to one another. By reference to FIG. 3, the parts are shown in the retracted position, that is, with the bend arm assembly 30 having a vertical surface thereof in edge abutting relation with an adjacent edge of the bed 10. This position corresponds to the position of the parts before the tube 15 is bent.

In FIG. 4, there is drawn a broken line designated "T", which is a line extending through the center of the bend arm shaft 44, and extends on a line generally perpendicular to the longitudinal axis of the bend arm 38, this line "T" diagrammatically depicting the feed line direction of the tube 15. A second broken line designated "A" has been drawn through the centers of the bend arm shaft 44 and the motor drive shaft 37. The angle "B" between these two lines is about ten to fifteen degrees.

In the position shown in FIG. 4, the short leg 38*a* of the bend arm 38 extends along a line slightly offset from the feed direction line "T" of the tube 15. During pivoting of the bend arm 38 to the broken line position designated 38', the angle of pivoting is in excess of one hundred eighty degrees, which, in part, is attributable to the L-shaped configuration of the link arm members 50, 51, and, in part attributable to the angle "B" between the feed direction line "T" and the line "A". At this point of maximum pivoting of the bend arm 38 to broken line position 38', the link arm members are in the broken line positions designated 50', 51'. That is, the angular configuration of the short leg 50*a*, 51*a* relative to the long leg 50*b*, 51*b* of the link member 50, 51, as well as the orientation of these legs relative to the pivoting direction, enables pivoting of the bend arm 38 through an angle in excess of one hundred eighty degrees without interference between shaft 44 and link 50. In one embodiment, the parts are configured to provide a maximum bend angle of about two hundred degrees, As shown in FIG. 4, the motor driven bell crank member 40, when pivoted from the solid line position 40 to the broken line position 40', traverses an arc in the clockwise direction. The bend arm 38 of the bend arm assembly 30 likewise traverses the same arc from the solid line position 38 to the dotted line position 38'. The angled end of the upper link arm member 50 is oriented in such a manner that the inner angle formed by the two legs lies, in the dotted line pivoted position, in proximate relation to the bend arm pivot shaft 44, that is, the inner angle enables the pivot pin 49 of the short leg 50*a* of the link arm member 50 to traverse an arc around the shaft 44, which arc is limited only by the angle and the width of the link arm member 50 in proximity to the shaft 44.

The linkage components of the drive mechanism 28 are dimensioned, configured and arranged so that the link arm members 50 and 51 remain parallel throughout the pivoting, that is, it is generally a parallelogram arrangement. By reference to FIG. 4, another broken line, designated "S", has been drawn between the center of the motor shaft 37 and the center of the pivot pin 57 of the link arm member 50, with line "S" being angularly offset counterclockwise from line "A" through an angle designated "C". With respect to the embodiment illustrated, this angle is approximately seven degrees. With the pivot pin 58 displaced ninety degrees relative to pivot pin 57, the angle between an imaginary line drawn through the center of shaft 37 and the center of pivot pin 58 will define an angle of about eighty-three degrees between this imaginary line and line "A".

The operation of the forces applied by the link arm members 50 and 51 will now be described, utilizing the line "A" as a reference point. The action of each link arm member will be discussed as either "pulling" or "pushing", with a pull being defined as movement of the respective link arm member in a direction generally to the right as viewed in the drawing. Correspondingly, a push is defined as a movement of the link arm in a direction generally to the left as viewed in the drawing.

During bending, the rotation of the drive shaft 37 is clockwise as viewed in FIG. 4 of the drawings. As previously mentioned, at rest and prior to bending, the parts are in the solid line positions shown in FIG. 4. At this point, the pivot pin is displaced counterclockwise from line "A" through an angle of about seven degrees.

As the drive shaft 37 commences rotation in the clockwise direction, the bell crank member 40 moves clockwise. During this initial movement, and through the angle "C" of about seven degrees, the link 50 moves a small increment to the right, that is, link 50 is pulling, and this pull force is transmitted to the short leg portion 38*a* of bend arm 38. Simultaneously, through this same angle, link arm member 51 is moving to the left, that is, it is pushing the long portion of the bend arm 38 outwardly in a clockwise direction.

As the pivot pin 57 of link arm member 50 passes through line "A", the direction of movement changes. Link arm member 50 is now moving left in a pushing direction. At this precise moment, link arm member 51 is likewise moving to the left and pushing. This concurrent pushing action of both link arm members 50 and 51 continues through a total angle of rotation of drive shaft 37 of about ninety-seven degrees, at which point the center of pivot pin 58 of link arm member 51 lies on the line "A".

At this point, link arm member 51 commences movement to the right, that is, in a pulling direction, while link arm member 50 is still moving in a pushing direction. The combined action of link arm member 50 pushing and link arm member 51 pulling continues through an additional angle of ninety degrees, that is, from ninety-seven degrees to one hundred eighty-seven degrees of rotation of motor drive shaft 37.

Beyond one hundred eighty-seven degrees to the maximum bend angle of about two hundred degrees, both link arm members 50 and 51 are moving to the right, that is, in a pulling direction.

Thus it can be seen that the magnitude of the rotational force transmitted by either one of the links 50, 51, to the crank portion of bend arm 38 varies with the rotational position of the motor shaft 37. But, it can also be seen that whether a link is moving to the right or left, that is, whether it is pushing or pulling, the net effect of the force on rotation of the bend arm assembly 30 during the bending operation is positive, and, in the clockwise direction.

With the link drive arrangement, no force is transmitted at the point of transition of direction of a link arm member 50 or 51, that is, when the link direction changes from pushing to pulling, or vice versa. No force is transmitted to the bend arm assembly 30 by the link arm member in transition. Maximum transmission of force occurs at a point about ninety degrees removed from this transition point. Consequently, with two link arm members having the driven pivot pins 57 and 58, for example, angularly displaced through some angle, such as ninety degrees, when one link arm member is contributing minimum force, the other is contributing maximum force, and, in all positions in between, both are cooperating to produce an additive force which is translated to rotational force of the bend arm assembly 30. Thus, the net transmitted bending force varies less than does the force of any one link during the bending operation, and a significant net rotational force is transmitted at all rotational positions. This ninety degree phase relation is preferred, but not necessary. This angle should be greater than zero degrees, but less than one hundred eighty degrees.

The drive mechanism 28 of the present invention thus provides for a solid coupling between the motor drive shaft 37 and the driven bend arm pivot shaft 44, with no chain drive and its attendant sprocket, and no bulky rack or gear drives intruding into the bend area or interfering with the bending operation. The link drive thus provides a rigid noncompliant and compact driving arrangement for transmitting the relatively high rotational forces required to drive the bending machine bend arm. Furthermore, the forces are transmitted directly, without complex and unnecessary intervening yieldable components, along a straight line through the solid link arm members 50 and 51 from the motor driven bell crank 40 to the bend arm 38. The points of interconnection are few and are limited to the coupling with the respective drive shaft 37 and driven shaft 44, along with the four pivot pin connections, thus providing a minimal number of wear points, with virtually no adjustment, and minimum lubrication. Also, as can be seen in FIG. 3, the motor 35 is positioned well behind the bend axis 19 beneath the bed 10. With the link arm member 50 above the bend arm 38 and the lower link arm member 51 below the bend arm member 38, the vertical intrusion of the link drive arrangement into the area therebelow along bend axis 19 is minimal and limited to the vertical dimension or thickness of the link arm member 51, thus providing space below the bend arm assembly 30 into which a tube 15 may extend for enabling complex serpentine bends.

It is to be understood that the directional terms herein employed, such as upwards, downwards, horizontal, vertical and the like, are used with reference to the normal orientation of the components, or with specific reference to the orientation shown in the drawings and are not to be construed as limiting. It is to be further understood that the operative component parts hereinabove described are formed of a suitable high strength material, such as steel or the like.

It is also to be understood that the magnitude of the angles "B" and "C" above described may be varied along with the angular orientation between the short and long legs of the link arm members 50 and 51, with suitable reconfiguration of link members 50 and 51, along with reconfiguration of the interconnection to the drive and driven bell crank means.

While there has been shown and described a preferred embodiment, it is to be understood that various other adaptations and modifications may be made within the spirit and scope of the invention.

What I claim is:

1. A bending apparatus comprising:

bed means;

a bend arm assembly pivotable relative to said bed means about a pivot shaft for bending a workpiece having a portion thereof restrained;

motor means including a drive shaft in generally parallel relation to said pivot shaft;

first bell crank means secured to said drive shaft for pivoting therewith;

second bell crank means secured to said pivot shaft for pivoting therewith;

first and second generally rigid, generally identical link members, each of said link members having first and second ends, said link members having the first ends thereof coupled to said first bell crank means and the second ends thereof coupled to said second bell crank means, the interconnection of said link members to said first and second bell crank means enabling pivoting of said bend arm assembly about said pivot shaft under rotational force from said motor means.

2. The apparatus according to claim 1 wherein each of said bell crank means include first and second pivot pin means for interconnection with said first and second link members.

3. The apparatus according to claim 2 wherein the pivot pin means of said first bell crank means are radially displaced relative to the pivot axis of said drive shaft a given distance, and angularly displaced relative to one another about said pivot axis through a given angle.

4. The apparatus according to claim 3 wherein the pivot pin means of said second bell crank means are radially displaced said given distance from the axis of said drive shaft and angularly displaced relative to one another about said drive shaft axis through said given angle.

5. The apparatus according to claim 1 wherein said first and second link members are generally L-shaped.

6. The apparatus according to claim 5 wherein said first and second link members lie in generally parallel relation.

7. A bending apparatus including bend arm assembly comprising a bend arm pivotable about a pivot shaft with a bend die on the pivot shaft, the bend die having workpiece receiving means coacting with workpiece clamping means on the bend arm, said apparatus including an improved bend arm drive mechanism comprising:

motor means including a drive shaft in generally parallel relation to the pivot shaft;

first bell crank means secured to said drive shaft for pivoting therewith and having first and second pin means angularly displaced relative to one another with each pin means being radially displaced the same distance from the pivot axis of said drive shaft;

second bell crank means secured to said pivot shaft for pivoting therewith and having first and second pin means angularly displaced relative to one another through the same angle as said pin means of said first bell crank means, said pin means of said second bell crank means being radially displaced from the pivot axis of said pivot shaft the same distance, which distance is generally equal to the radial displacement of said pin means of said first bell crank means; and first and second generally rigid, generally identical link members, each of said link members having first and second ends, said link members having the first ends thereof coupled to said first and second pin means of said first bell crank means and the second ends thereof coupled to said first and second pin means of said second bell crank means, with said first and second link members in generally parallel relation, the interconnection of said link members to said first and second bell crank means enabling pivoting of said bend arm assembly about said pivot shaft under rotational force of said motor means.

8. The bend arm drive mechanism of claim 7 wherein said first and second link members are generally L-shaped.

9. In a bending machine having a swinging bend arm assembly mounted for rotation about the axis of a bend die shaft which carries a bend die, an improved drive for the bend die shaft comprising:

a drive lever fixed to said swinging bend arm assembly and having first and second mutually spaced drive points equally spaced from said axis;

a driven lever mounted for rotation about a drive axis and having third and fourth mutually spaced drive points equally spaced from said drive axis;

power means for rotating said driven lever about said drive axis, and first and second link means pivotally connected to said levers at said drive points for causing said drive lever to rotate in response to rotation of said driven lever enabling pivoting of said bend arm assembly about said drive axis under rotational force of said power means.

10. The machine of claim 9 wherein said link means comprise a first rigid link having end portions pivotally connected to said levers at said first and third drive points, respectively, and a second rigid link having end portions connected to said levers at said second and fourth drive points, respectively.

11. The machine of claim 10 wherein the pivotal connection between at least one of the links and said drive lever is offset from the longitudinal axis of said one link.

12. The machine of claim 10 wherein each said link is substantially L-shaped, having a short leg pivotally connected to said drive lever and a long leg pivotally connected to said driven lever.

13. The machine of claim 9 wherein lines between said bend die shaft axis and each of said first and second drive points define an angle of more than zero degrees and less than one hundred eighty degrees.

14. The machine of claim 13 wherein lines between said drive axis and said third and fourth drive points define an angle of about ninety degrees.

15. A bending apparatus for bending a workpiece relative to a given line and including a bend arm pivotable from a first position to a second position about a pivot shaft with a bend die on the pivot shaft, the bend die having workpiece receiving means coacting with workpiece clamping means on the bend arm, said apparatus comprising:

motor means including a drive shaft in generally parallel relation to the pivot shaft, the center of said drive shaft lying along an imaginary line through the center of said pivot shaft, which line is angularly offset from said given line;

first lever means secured to said drive shaft for pivoting therewith and having first and second pin means angularly displaced relative to one another through a predetermined angle, with each pin means being radially displaced a predetermined distance from the pivot axis of said drive shaft;

second lever means secured to said pivot shaft for pivoting therewith and having first and second pin means angularly displaced relative to one another through said predetermined angle, said pin means of said second lever means being radially displaced from the pivot axis of said pivot shaft the same said predetermined distance; and first and second generally rigid, generally identical link members, each of said link members having first and second ends, said link members having the first ends thereof coupled to said first and second pin means of said first lever means and the second ends thereof coupled to said first and second pin means of said second lever means, said link members being dimensioned, configured and arranged for enabling, at least in part, the pivoting of said bend arm from said first position to said second position about said pivot shaft through an angle of at least one hundred eighty degrees under the rotational force of said motor means.

16. The bending apparatus of claim 15 wherein said first and second link members are generally L-shaped.

17. The bending apparatus of claim 16 wherein said first and second link members are generally L-shaped, with each of said link members having a short leg and a long leg, and wherein the distal ends of the short legs thereof are pivotally coupled to said pin means of said second lever means.

18. The bending apparatus of claim 17 wherein distal ends of the long legs of said first and second link members are pivotally coupled to said pin means of said first lever means.

19. The bending apparatus of claim 18 wherein the angle between the long leg and short leg of each of said link members is an obtuse angle.

20. In a bending machine having a swinging bend arm assembly mounted for rotation about the axis of a bend die shaft which carries a bend die, an improved drive for the bend die shaft comprising:

drive lever means fixed to said swinging bend arm assembly and having first and second mutually spaced drive points equally spaced from said axis, said first and second drive points and said axis defining a given angle;

driven lever means mounted for rotation about a drive axis and having third and fourth mutually spaced drive points equally spaced from said drive axis, said third and fourth drive points and said drive axis defining an angle equal to said given angle;

power means for rotating said driven lever means about said drive axis, and first and second rigid noncompliant link means pivotally connected at first ends to said drive lever means and, at second ends to said driven lever means at said drive points for causing said drive lever to rotate in response to rotation of said driven lever enabling pivoting of said bend arm assembly about said drive axis under rotational force of said power means.

21. The machine of claim 20 wherein said given angle is about ninety degrees.

22. The machine of claim 20 wherein said given angle is that angle at which one of said link means exerts maximum force while the other of said link means exerts minimum force.

23. The machine of claim 20 wherein wherein each of said link means is a substantially L-shaped link member having a short leg pivotally connected to said drive lever means and a long leg pivotally connected to said driven lever means.

24. The machine of claim 23 wherein said given angle is about ninety degrees.

* * * * *